United States Patent [19]

Boman

[11] Patent Number: 4,584,775

[45] Date of Patent: Apr. 29, 1986

[54] ROOFERS SQUARE AND CAP CUTTER

[76] Inventor: Keith H. Boman, 844 S. Eight Mile, Midland, Mich. 48640

[21] Appl. No.: 661,045

[22] Filed: Oct. 15, 1984

Related U.S. Application Data

[63] Continuation-in-part of Ser. No. 481,302, Apr. 1, 1983, abandoned.

[51] Int. Cl.[4] ..... G01B 3/30

[52] U.S. Cl. ..... 33/188; 33/481; 33/482; 33/474

[58] Field of Search ..... 33/188, 187, 174 R, 33/174 G, 481, 482, 479, 480, 474, 476, 411

[56] References Cited

U.S. PATENT DOCUMENTS 368,574 8/1887 Eby ..... 33/187

1,645,808 10/1927 Gregel ..... 33/188

2,816,367 12/1957 Fink et al. ..... 33/188

3,548,505 12/1970 Candilo ..... 33/174 R 4,208,799 6/1980 Frantello ..... 33/187

*Primary Examiner*—Harry N. Haroian

*Attorney, Agent, or Firm*—Robert L. McKellar

[57] ABSTRACT

What is disclosed are novel tools for facilitating the laying of roof shingles so that shingles can be aligned on a roof to give regular and even courses. The tools provide an alignment and spacing of the shingles without the need of utilizing gauges or tools that require adjustments, and the lightweightness and small size of the tools provide easy storage at the worksite on the roof so that the workman need not make repeated trips to the ground to recover tools not having the advantages herein for storage, that have been dropped or dislodged.

2 Claims, 9 Drawing Figures

10
11
12
13
14
15
16
17
20
21
22
23
24
30
31
32
33
40
50
A
x

ROOFERS SQUARE AND CAP CUTTER

This application is a continuation-in-part application of U.S. Ser. No. 481,302, filed Apr. 1, 1983, now abandoned.

FIELD OF INVENTION

The invention disclosed herein deals with roof shingling tools which are lightweight, durable, inexpensive, accurate, simply constructed and easy to use and store. These tools allow for the alignment and spacing of adjacent rows of shingles such that the shingle rows are parallel to each other and also parallel to the leading edge of the roof on which they are being placed.

BACKGROUND OF THE INVENTION

Shingles which are attached to the roofs of buildings to protect the interior of the buildings from inclement weather are currently manufactured in a few standard sizes such that the overall size of such shingles does not vary considerably. When these commercial shingles are used by roofers, a single row of shingles is first aligned with the lower leading edge of the roof to be shingled and then successive layers of shingles are overlapped on the preceding row of shingles, and are laid parallel therewith. In addition, the shingles are laid in a manner such that they generally abut each other from side to side or, there is a small amount of lateral spacing between the ends of the shingles. The construction of the individual shingles is significant, in that, for the purposes of the aesthetic pattern that the shingles make on a finished roof, the shingles are designed with notches which extend part of the way through the shingle. These notches are evenly spaced apart in the shingle from side to side and they extend approximately one-half of the way through the shingle from the bottom edge of the shingle towards the top edge of the shingle. Owing to the even spacing of these notches, each shingle is designed on its end edges with what amounts to half a notch, such that when the shingle is laterally abutted to a neighboring shingle, the half notches in each shingle come together to form a full notch and thus maintain the continuity of the notch pattern from one side of the roof to the other. The shingles are misaligned from row to row such that the notches are staggered to create an even pattern.

In order to keep the shingle rows straight and parallel to the leading edge of the roof, and also in order to maintain consistent lateral spacing between adjacent shingles so that the final result is an aesthetically pleasing fully protected roof, there have been many methods and devices created and used.

The earliest and simplest method was and is the use of a chalk line which lays down a visible mark at a measured distance above and parallel to the previous row of installed shingles. The chalk line is measured a predetermined distance above the installed shingle, and from side to side on the roof, and the top edge of the next successive row of shingles is laid up against the line and nailed into place to give a straight and parallel row of shingles. This method however is laborious and does not allow for a consistent lateral spacing between adjacent shingles in the same row. Moreover, quite often the roofer must cut shingles in various lengths and in various shapes in order to complete the aesthetic quality of the roof. The extra cutting and fitting always requires additional hand tools, such as, squares or analogous straight edged tools; measuring devices, although some squares have measured gradations along their edges; patterns and the like. The problem with the extra tools, of course, is the problem of where to store the tools on the rooftop so that they will be handy to the roofer while at the same time they will be secure from slipping and sliding to the ground.

A second problem is the problem of handling the extra tools, the shingle and the nails and hammer all at the same time in order that the shingle be placed, aligned, held in place and nailed without losing alignment and/or the tools, nails, hammer, or the roofer, to the ground.

Many devices have therefore been developed to aid the roofer to align, space, hold and nail the shingle. Some of the devices in the prior art, however, have merely been gauges, mostly patterned after the simple carpenters gauge. None of these devices have the ability to maintain the gauged shingle in the aligned and spaced position. The skilled roofer, using such prior art devices, must still hold the aligned and spaced shingle in position while managing to nail the shingle in place. Such devices are shown in U.S. Pat. No. 853,198, issued May 7, 1907; U.S. Pat. No. 1,210,469, issued Jan. 2, 1917 and U.S. Pat. No. 1,645,808, issued Oct. 18, 1927.

In a similar manner, there have been gauge devices designed that align and space the shingles and also hold the shingle in place. These devices operate by being clamped tightly to the bottom edge of the shingles on an installed row of shingles. The shingles to be installed are then placed on the aligning device such that the bottom edge of the shingle being installed is supported by an edge of the alignment device, a predetermined distance gauged by the device, so that the shingle to be installed is properly aligned and spaced with the proper overlap, and is held in this position until nailed in place. Such devices are shown in U.S. Pat. No. 4,110,911, issued Sept. 5, 1978 and U.S. Pat. No. 4,183,144, issued Jan. 15, 1980.

The disadvantage of these devices is that they are cumbersome and are difficult to store on a rooftop when not in use and moreover, they have no other function, except perhaps as a straight edge for cutting purposes. Furthermore, these devices require the use of clamps and springs or knurled nut and bolt clamping devices which must be operated each time the device is moved and repositioned, all of which causes the loss of time, and inconvenience, for the roofer.

The roofers square and cap cutter and alignment tools of this invention overcome the disadvantages of the devices of the prior art.

The devices of the instant invention are of simple construction without the use of nuts and bolts, springs and clamps. The devices of the instant invention are accurate, durable, lightweight, inexpensive, easily placed and adjusted, give proper alignment and spacing, do not require that the roofer hold them in place and these devices provide many functions in addition to alignment, spacing and holding, such as straight edge, square, accurate bias cutting and template for patterns for special cutting and capping work.

THE INVENTION

The present invention overcomes the difficulties of the prior art devices by providing two simply constructed tools to carry out all the functions that a skilled roofer must perform, which tools can be carried in the roofers pocket when not in use and which are operated easily and efficiently to align, space and hold shingles when a roof is being installed.

In brief, the roofers square according to this invention comprises a single flat member of L-shaped configuration having a vertical leg and horizontal leg; the vertical leg having on the upper edge of its back planar surface, a downwardly directed lip such that a rail is formed on the upper edge of the back planar surface to adapt to and engage the edge of a shingle; the horizontal leg having an upwardly directed lip on the lower edge of its front planar surface, which lip is oppositely directed from the lip formed on the vertical leg to form a rail, said horizontal leg lip constructed to adapt to and engage the edge of a shingle.

A second aspect of this invention comprises a cap cutter and alignment tool. This device according to the invention comprises a single flat member of elongated trapezoidal shape, having on the upper edge of its back planar surface, a downwardly directed lip such that a rail is formed on the upper edge of the back planar surface to adapt to and engage the edge of a shingle; having on the lower edge of its front planar surface, an upwardly directed lip, which lip is oppositely directed from the lip formed on the back planar surface, to adapt to and engage the edge of a shingle and, optionally, a depression in the middle of the lower one-half of the front planar surface that serves as a fulcrum point by which the upper edge of the device can be easily lifted from the shingle on which it has been placed.

A third aspect of this invention involves the roofing process wherein the roofers square is used by itself or is used in combination with the cap cutter and alignment tool.

BRIEF DESCRIPTION OF THE DRAWING

The devices of this invention will be more clearly understood upon reference to the following detailed description when read in conjunction with the accompanying drawings, wherein like reference characters refer to like parts throughout the specification and the drawings.

DETAILED DESCRIPTION OF THE PRESENT INVENTION

Figures 1, 2, 3, 4, 5, 6, 7:
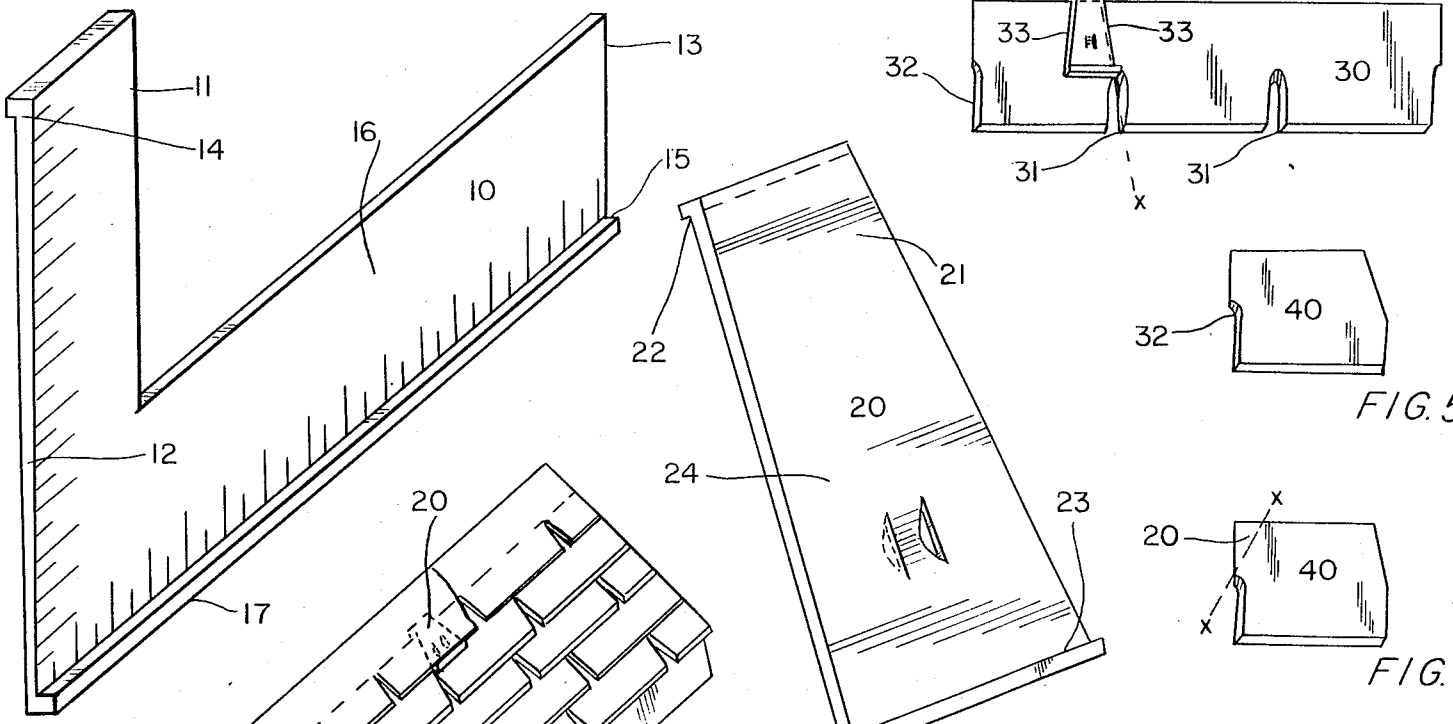
FIG. 1 is a perspective view of the roofers square.
FIG. 2 is a perspective view of the cap cutter and alignment tool.
FIG. 3 is a fragmentary perspective view showing the roofers square of this invention and the cap cutter and alignment tool of this invention during the installation of shingles on a roof.
FIG. 4 is a plan view of a commercial standard shingle with a cap cutter and alignment tool in place for the purpose of cutting a cap piece.
FIG. 5 is a plan view of an end piece cut from a shingle showing the irregular shape of a semi-finished cap piece.
FIG. 6 is a plan view of piece of a commercial shingle showing the final cut necessary to make a cap piece. The cap cutter is shown in place to guide and direct the cut line.
FIG. 7 is a plan view of finished cap piece.

With reference first to FIG. 1, the roofers square 10 of the present invention is shown in FIG. 1 and comprises a single, essentially flat member of L-shaped configuration having a vertical leg 11 and a horizontal leg 13. The vertical leg 11 has along the upper edge of its back planar surface 12, a downwardly directed lip 14 which forms an inverted rail across the top width of the vertical leg 11. This rail or lip 14 has a width approximately equal to the thickness of a standard shingle. When in use, the rail or lip 14 is hooked over the top edge of an installed shingle and thus supports the roofers square 10 on the shingle and prevents the roofers square 10 from sliding off the roof surface. The horizontal leg 13 has an upwardly directed lip 15 along the bottom lower edge of its front planar surface 16. The lip 15 is oppositely directed from the lip 14 that is formed on the vertical leg 11. The lip 15 also has a width approximately equal to the thickness of a standard shingle and runs the bottom width of the horizontal leg 13. When the roofers square is in use, the lip 15 receives the bottom edge of a shingle to be installed. When the shingle to be installed is in place on the roofers square 10, the shingle is automatically aligned to be parallel with the previous row of shingles and held in place without the necessity of the roofer having to hold the shingle until nailed. After the shingle to be installed is nailed down, the roofers square 10 can be easily removed. It should be noted that the width of the vertical leg 11 can be varied but it is preferred to have the width of the vertical leg 11 at least about one and one-half inches in order to insure that the roofers square does not slip down from the weight of any shingle placed thereon. Further, it is preferred not to have the vertical leg 11 be too wide as it may interfere with the nails used to affix the shingle to the roof.

The horizontal leg 13 can also vary in width and length but it is preferred to have the width of horizontal leg 13 be approximately the same width as the vertical leg 11 in order that the shingle can be nailed without interference from the horizontal leg 13. The length of the horizontal leg 13 is not overly critical but it should be at least twelve inches long in order to perform the function of supporting a shingle in place. Moreover, a standard shingle is approximately twelve inches wide from top to bottom and the twelve inch long horizontal leg 13 serves as a straight edge 17 when it is required that the shingle be cut along a straight line anywhere along its width. Further, although it is not a critical aspect of this invention, the outside edges of both the vertical leg 11 and the horizontal leg 13 can be marked with gradations such that either edge can serve as a measuring device when it is required that pieces of shingle be cut and fitted in order to fully protect any roof being shingled. Another aspect of this invention is the L-shaped configuration of the roofers square 10 which allows the roofer to cut square corners on smaller pieces of shingles so that such smaller pieces will align with the standard shingles. This feature of the instant invention device means that a roofer does not have to carry an additional carpenter square to the roof site and thus, this feature of the invention means the roofer does not have to worry about storing the carpenters square on the rooftop nor does the roofer have to deal with a large cumbersome tool. It should also be noted by those skilled in the art that the device of the instant invention can be used either left-handed or right-handed.

Figure 8:
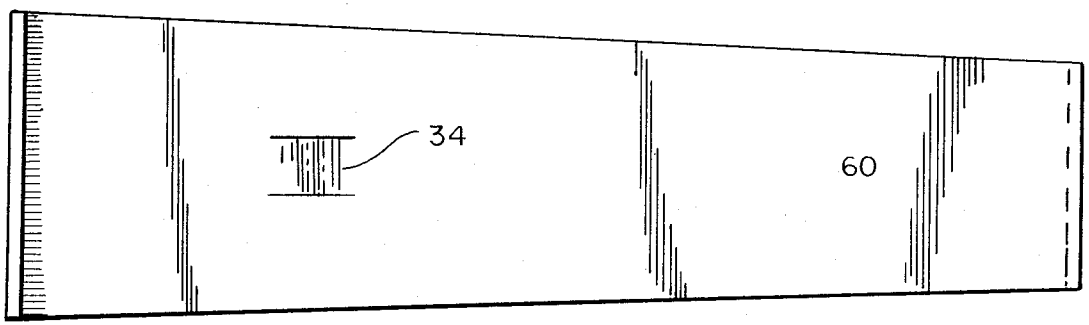
FIG. 8 is a plan view of the cap cutter showing the upper planar surface of the cap cutter.
Figure 9:
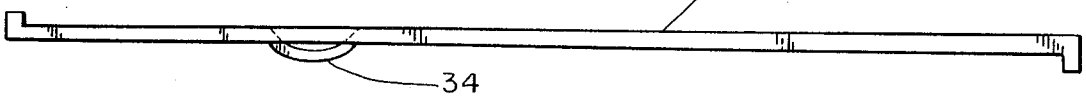
FIG. 9 is an edge view of the cap cutter showing a side view of the depression which is used as a fulcrum.

With reference to FIG. 2, the cap cutter and alignment tool 20 of the present invention is shown in FIG. 2 and comprises a single, essentially flat member having an elongated trapezoidal configuration. The cap cutter and alignment tool has on the upper edge of its back planar surface 21, a downwardly directed lip 22 which forms an inverted rail across the width of the top of the cap cutter and alignment tool cutter 20. This lip or rail 22 has a width approximately equal to the thickness of a standard shingle. The length of the cap cutter and alignment tool 20 is the same as the height of the vertical leg 11 shown in FIG. 1 so that when the two units are used together, as described infra in this specification, the supported shingle will align at the same height all along its width. When in use, the rail or lip 22 is hooked over the top edge of an installed shingle and supports the cap cutter and alignment tool 20 from sliding off the roof surface. The cap cutter and alignment tool 20 has an upwardly directed lip 23 along the lower edge of its front planar surface 24. The lip 23 is oppositely directed from the lip 22 that is formed at the top of the cap cutter and alignment tool 20. The lip 23 also has a width approximately equal to the thickness of a standard shingle and runs the width of the bottom of the cap cutter and alignment tool 20. Referring to FIGS. 8 and 9, there is shown a protuberance 34 in the lower half of the back planar surface. This protuberance, as the convex surface on the back planar surface, serves as a fulcrum when one desires to remove the cap cutter after a shingle is laid. It operates by touching the upper planar surface just below the protuberance which causes the lip of the lower planar surface to be lifted from the edge of the shingle, thereby allowing easy movement and removal of the device from the shingle. When in use as an alignment tool, in conjunction with the roofers square 10, shown in FIG. 1, the top lip 22 hooks over the top edge of the installed shingle and the bottom lip 23 supports the shingle to be installed at its bottom edge. Thus, the cap cutter and alignment tool 20 can be used in conjunction with the roofers square 10 to help support and align one end of a shingle to be installed. The use of the inventive devices herein, in combination, can be seen illustrated in FIG. 3.

As eluded to in the opening paragraphs of this specification, modern shingles are constructed so as to have notches in the shingle which extend part of the way through the shingle from bottom to top. As indicated earlier, these notches are evenly spaced along the bottom of the shingle such that when the shingles are properly overlapped and abutted and the shingles are staggered, there develops an aesthetically pleasing pattern in the roof design. As indicated above, when the shingles are properly abutted against one another in a row, the half notches in the end of the shingles meet to form a full notch and maintain the continuity of the design.

Unfortunately, however, when shingles are used to put a cap on the ridge of a finished roof, these half notches cause some problems. The cap shingles are cut from standard roof shingles in order to minimize the cost of the roofing job and also to expedite the finishing of the roof. Shown in FIG. 4, is a conventional asphalt roofing shingle 30. The notches referred to above are designed as 31 and the half notches as 32 therein. Shown on the left hand side of the shingle at "A" is cap cutter 20 of this invention positioned for one of its intended uses, to act as a template and straight edge for cutting caps from asphalt shingles. With the cap cutter 20 in place, the roofer merely cuts along both straight edges 33 to the open notch 31. Such cuts leave a semi-finished cap piece 40 having the configuration shown in FIG. 5. This piece of shingle is not ready for use as a cap piece since there still remains one more cut to give a uniform cap piece, which when put in place in the cap on the ridge of the roof, will give a uniform straight line to the finished cap. FIG. 6 shows the semi-finished cap piece 40 with the cap cutter 20 in place as a straight edge and template to make the last cut to give a cap piece. The cut as illustrated in FIG. 6 would be taken along the line XX to give the final cap piece 50 as shown in FIG. 7. As can be observed from the illustration in FIG. 4, when the cap cutter 20 is used twice, to cut three pieces from the shingle 30, the center piece automatically becomes a finished cap piece having the configuration shown in FIG. 7. What remains then is for the roofer to trim the two remaining pieces having the configuration shown in FIG. 5, to give pieces having the configuration shown in FIG. 7. It is preferred that the width of the top of the cap cutter 20 be about one-half of the width of the bottom of the cap cutter 20 in order to give enough angle to the cap cutter 20 to cause the configuration as shown in FIG. 7. The ratio of the width of the top, to the width of the bottom of the cap cutter 20, is not critical, as long as the ratio is such that an angle is cut on the edges of the cap in order that the top half of the edge of the cap is not visible when the caps are put in place. This results in essentially a straight edge on the final cap without any aberrations in the cap thus giving an aesthetically pleasing appearance to the finished cap. When the cap cutter is not in use, the roofer can merely slip the device in his pocket for safekeeping, thus preventing it from sliding from the rooftop. This simple device precludes the use of several extra tools on the rooftop that ordinarily encumber the skilled roofer.

It should now be appreciated that the roofers square 10 and the cap cutter and alignment tool 20 are not only simple in construction but versatile in function and therefore simple to use.

Having described my invention, many modifications thereto will become apparent to those skilled in the art to which it pertains without deviating from the spirit of the invention as defined by the scope of the appended claims.

That which is claimed is:

1. A cap cutter and alignment tool comprising a single flat member of elongated trapezoidal shape, having on the upper edge of its back planar surface, a downwardly directed lip such that a rail is formed on the upper edge of the back planar surface to adapt to and engage the edge of a shingle; having on the lower edge of its front planar surface, an upwardly directed lip, which lip is oppositely directed from the lip formed on the back planar surface, to adapt to and engage the edge of a shingle, said cap cutter having a protuberance extending from the middle of its lower one-half back planar surface, the protuberance to serve as a fulcrum point for the cap cutter.

2. A process of shingling a roof wherein there is used in combination, a roofers square comprising a single flat member of L-shaped configuration having a vertical leg and a horizontal leg; the vertical leg having on the upper edge of its back planar surface, a downwardly directed lip such that a rail is formed on the upper edge of the back planar surface to adapt to and engage the edge of a shingle; the horizontal leg having an upwardly directed lip on the lower edge of its front planar surface, which lip is oppositely directed from the lip formed on the vertical leg to form a rail, said horizontal leg lip constructed to adapt to and engage the edge of a shingle and a cap cutter and alignment tool comprising a single flat member of elongated trapezoidal shape, having on the upper edge of its back planar surface, a downwardly directed lip such that a rail is formed on the upper edge of the back planar surface to adapt to and engage the edge of a shingle; having on the lower edge of its front planar surface, an upwardly directed lip, which lip is oppositely directed from the lip formed on the back planar surface, to adapt to and engage the edge of a shingle, said cap cutter having a protuberance extending from the middle of the lower one-half back planar surface, the protuberance thereof to serve as a fulcrum point for the cap cutter, said process comprising, (I) attaching a first horizontal line of shingles onto the leading edge of a roof;

(II) placing the roofers square and the cap cutter and alignment tool on the horizontal shingles from (I) such that both have their top lips hooked over the top edge of the attached shingle and spaced not more than the length of one shingle apart;

(III) placing a shingle with its flat surface on the flat surface of the roof such that the lower edge of such shingle engages with and sets in the lower lip of each tool and abuts a like-placed attached shingle or the outside edge of a roof structure;

(IV) attaching the placed shingle to the roof;

(V) removing the roofers square and cap cutter and alignment tool, and (VI) repeating steps (II) and through (V) until the roof is essentially covered with shingles aligned on the roof to give regular and even courses.

* * * * *